United States Patent [19]

Russell

[11] 3,945,239

[45] Mar. 23, 1976

[54] METAL FORMING MACHINE WITH MULTIPLE EXTENDED BEDS

[75] Inventor: Frank S. Russell, Holden, Mass.

[73] Assignee: Sleeper & Hartley Corporation, Worcester, Mass.

[22] Filed: June 6, 1975

[21] Appl. No.: 584,398

[52] U.S. Cl. ..... 72/452; 72/402; 72/447; 72/455

[51] Int. Cl.[2] ..... B21J 13/02

[58] Field of Search ..... 72/402, 403, 407, 447, 72/452, 455

[56] References Cited

UNITED STATES PATENTS

| | | | |
|---|---|---|---|
| 3,246,502 | 4/1966 | Brignoli | 72/402 |
| 3,296,851 | 1/1967 | Breuer | 72/403 |
| 3,802,247 | 4/1974 | Karsnak | 72/455 |

*Primary Examiner*—C. W. Lanham
*Assistant Examiner*—Gene P. Crosby
*Attorney, Agent, or Firm*—Thomas N. Tarrant

[57] ABSTRACT

A metal forming machine for forming wire or metal strip in which the machine has two opposed bed supports extending parallel to each other and each bed support has a plurality of extended bed surfaces for supporting metal forming tools in a variety of arrangements.

12 Claims, 4 Drawing Figures

METAL FORMING MACHINE WITH MULTIPLE EXTENDED BEDS

BACKGROUND OF THE INVENTION

1. Field of the Invention

The present invention relates to metal forming machines and particularly to those in which continuous lengths of metal strip or wire are fed between reciprocating slides which coact with each other with or without forming mandrels to form the metal into desired shapes.

2. Description of the Prior Art

The most familiar machines, for metal forming of the same nature as with the present machine, are four-slide machines. Typically, a four-slide machine has a single horizontal bed surface from which are mounted four camshafts parallel to the bed surface and forming a rectangle around it. The camshafts are joined by mitre gears to provide a continuous drive train rotating the camshafts in unison.

Four slides, arranged in two opposing pairs perpendicular to each other, are reciprocated horizontally on the bed surface by cams mounted on the respective camshafts. Continuous lengths of wire or metal strip are fed in a straight line parallel to the bed surface and to one pair of opposing slides. Thus the wire or strip passes into a common center toward which each of the four slides is reciprocated for forming operations.

While the more common four-slide machine has a horizontal bed, both inclined and vertical bed designs have been produced. A vertical bed arrangement has the desirable advantage that both formed pieces and waste drop readily into provided containers instead of accumulating on the work surface.

A wire forming machine has also been made having a first bed surface machined horizontal on a bed support and a second bed surface machined on a vertical side of the bed support, both bed surfaces extending along parallel axes. It is known to mount four tool supports facing a common center on this bed arrangement, however this is accomplished by mounting two of the tool supports "piggy-back" on the other two. This piggy-back mounting limits versatility and support strength. The piggy-back tool support ends up too far from the bed surface to maintain the rigidity necessary for forming heavier metal.

SUMMARY OF THE INVENTION

In accordance with the present invention, a metal forming machine is provided having four bed surfaces extending along parallel axes and positioned so that four reciprocating tools mounted one from each bed surface at a common cross section of said axes will face a common center. The bed surfaces are provided two to each of two bed supports and four camshafts rotatable in unison extend parallel with said parallel axes and arranged around the bed supports so that each camshaft carries cams for actuating tools mounted from a respective bed surface. The machine is arranged for stock material to be fed through the common center along an axis parallel to said parallel axes and nonparallel with tools mounted from the bed surfaces. The bed supports may each have additional bed surfaces and each bed surface may have a plurality of tools mounted at different axial positions along the bed surface. Not only simple and multiple forming operations, but also assembly operations can be readily performed as a result of the greatly increased number of tools that can be supported in interacting positions.

Thus it is an object of the invention to provide a metal forming machine capable of mounting a large number of metal forming tools at a variety of positions.

Further objects and features of the invention will become obvious upon reading the following description together with the Drawing.

DESCRIPTION OF THE PREFERRED EMBODIMENT

Figure 1:
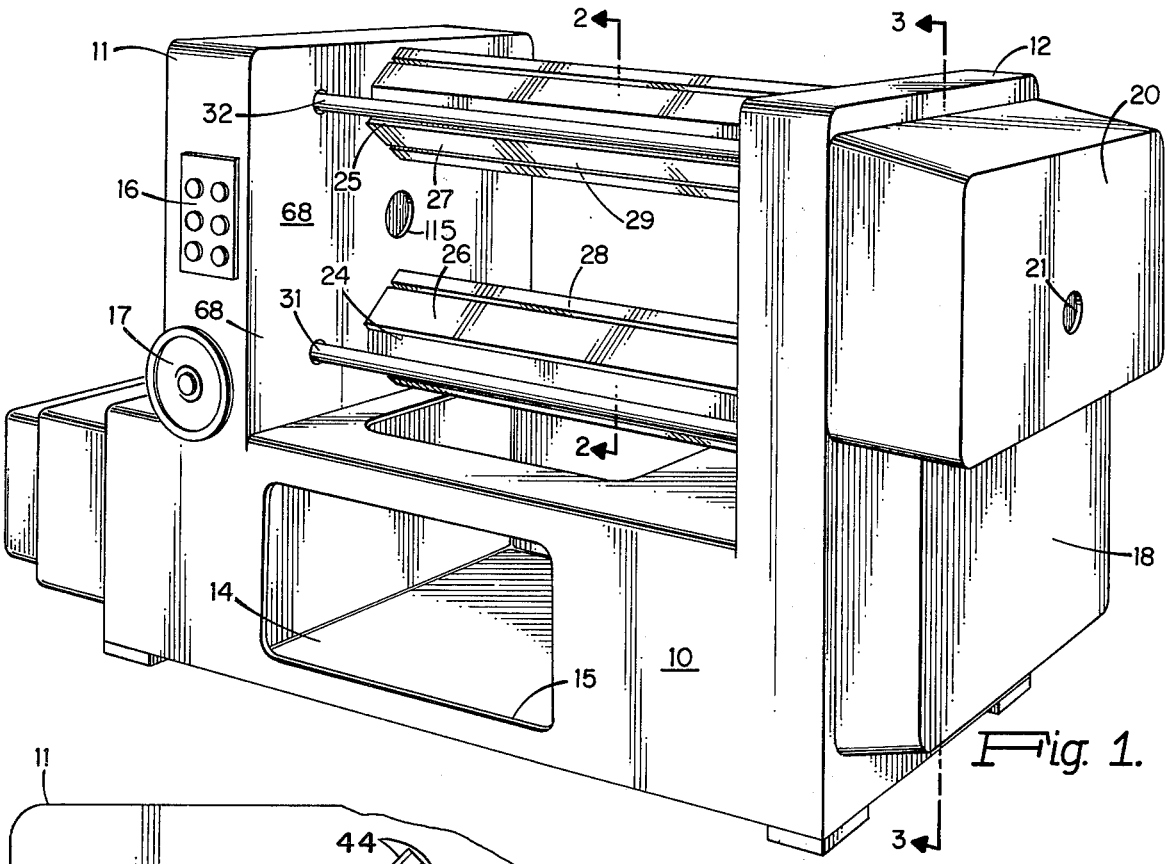
FIG. 1 is a perspective view of the metal forming machine according to the invention.

FIG. 1 is an overall perspective view of the present machine. The main frame includes horizontal base 10 and vertical end portions 11 and 12. Base 10 encloses a drive motor (not shown) and space 14 for receiving formed parts. Opening 15 provides access to space 14 through which a container for collecting the formed parts can be inserted and removed.

End portion 11 carries control panel 16 and manual wheel 17. Control panel 16 carries the switches for powered control while wheel 17 permits manual rotation of the machine's main drive shaft for set-up purposes.

End portion 12 contains the power transmission assemblies. Extension cover 18 covers the drive from the drive motor to the main drive shaft. Extension cover 20 above cover 18 encloses a stock feed mechanism. Aperture 21 in cover 20 is provided for feeding stock material into the machine.

Between end portions 11 and 12, bed supports 24 and 25 are secured. Bed surfaces 26 and 27 are provided on bed supports 24 and 25 as are bed surfaces 28 and 29 with the lead lines partly dashed in FIG. 1 since they are unseen surfaces of bed supports 24 and 25. Four camshafts, 31, 32, 33 and 34 are arranged parallel to bed supports 24 and 25 for operating tools secured in tool carriers mounted on bed surfaces 26, 27, 28 and 29. Camshafts 33 and 34 can be seen in FIGS. 2 and 3.

Figure 2:
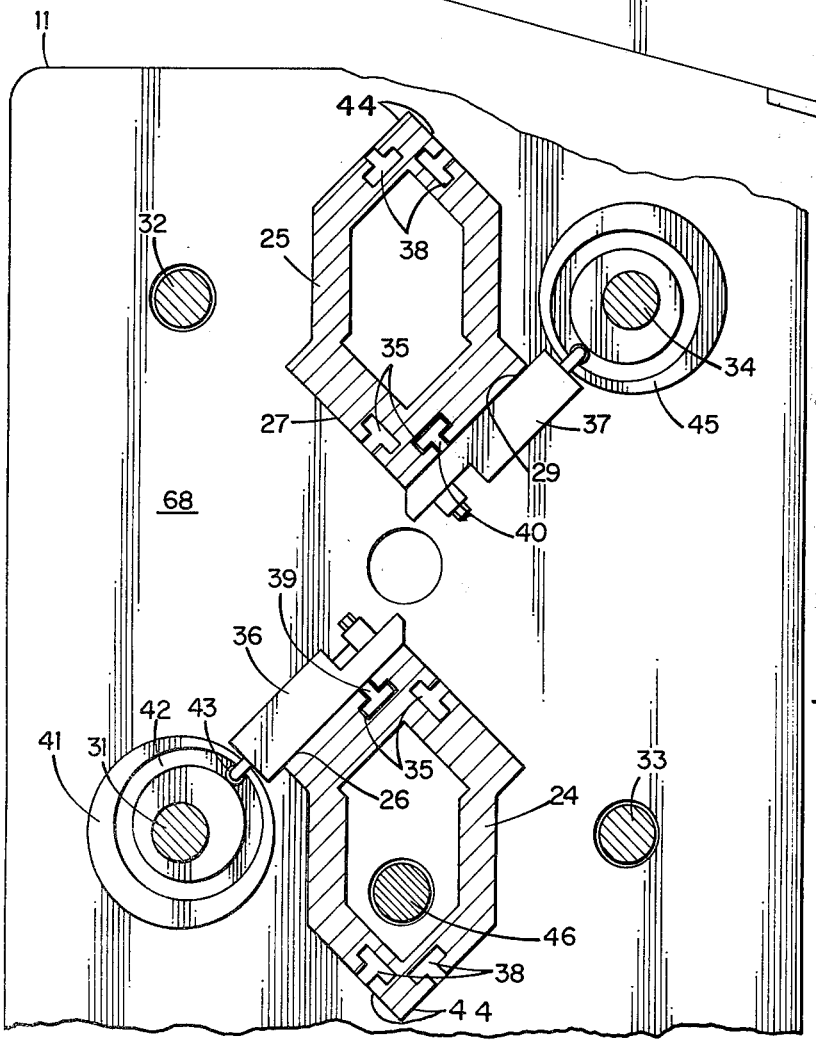
FIG. 2 is a sectional view through 2—2 of FIG. 1.

FIG. 2 depicts bed supports 24 and 25 as well as camshafts 31 through 34 in section. Bed supports 24 and 25 are cast with a polygonal section having a hollow interior such as to have great resistance to flex over an extended length. Bed supports 24 and 25 are suitably cast from iron or related alloy. Bed surfaces 26, 27, 28 and 29 are machined on at least two surfaces of each bed support 24 and 25. Tee-slots 35 are cast in bed supports 24 and 25 with slot openings along each of bed surfaces 26 through 29. FIG. 2 depicts tool slides 36 and 37 mounted on bed surfaces 26 and 29 respectively. Tool slides 36 and 37 are secured to respective bed surfaces by bolts 39 and 40 having heads riding in tee-slots 35.

Camshaft 31 carries cam 41 adjacent to tool slide 36. Cam 41 has an internal eccentric groove 42. Drive pin 43 rides in eccentric groove 42 and actuates the tool operation of tool slide 36. Eccentric groove 42 has both inside and outside cam surfaces to carry drive pin 43 both in and out as camshaft 31 rotates. Other types of tool slides readily usable with the present apparatus and operated by a cam having an outside cam surface only are returned by spring or fluid pressure. Tool slide 37 is actuated similarly by cam 45 secured to camshaft 34. Only two opposing tool slides are depicted in FIG. 2, however, a great many tool slides may be secured to bed surfaces 26, 27, 28 and 29. While tool slides 36 and 37 are depicted to provide strictly orthogonal operation, it should be recognized that angled tool slide devices are known and can be used with the present apparatus to increase the flexibility of operations available. Such angled devices provide forming operations along a diagonal as distinguished from perpendicular operations with respect to the work.

Four additional bed surfaces 44, on the reverse sides of bed supports 24 and 25, are located symmetrically relative to respective bed surfaces 26, 28, 27 and 29. Bed surfaces 44 contain tee-slots 38 for securing tool supports. Tools can be mounted from bed surfaces 44 for ancillary operations such as guiding, turning, cutting, holding and assembly functions.

Figure 3:
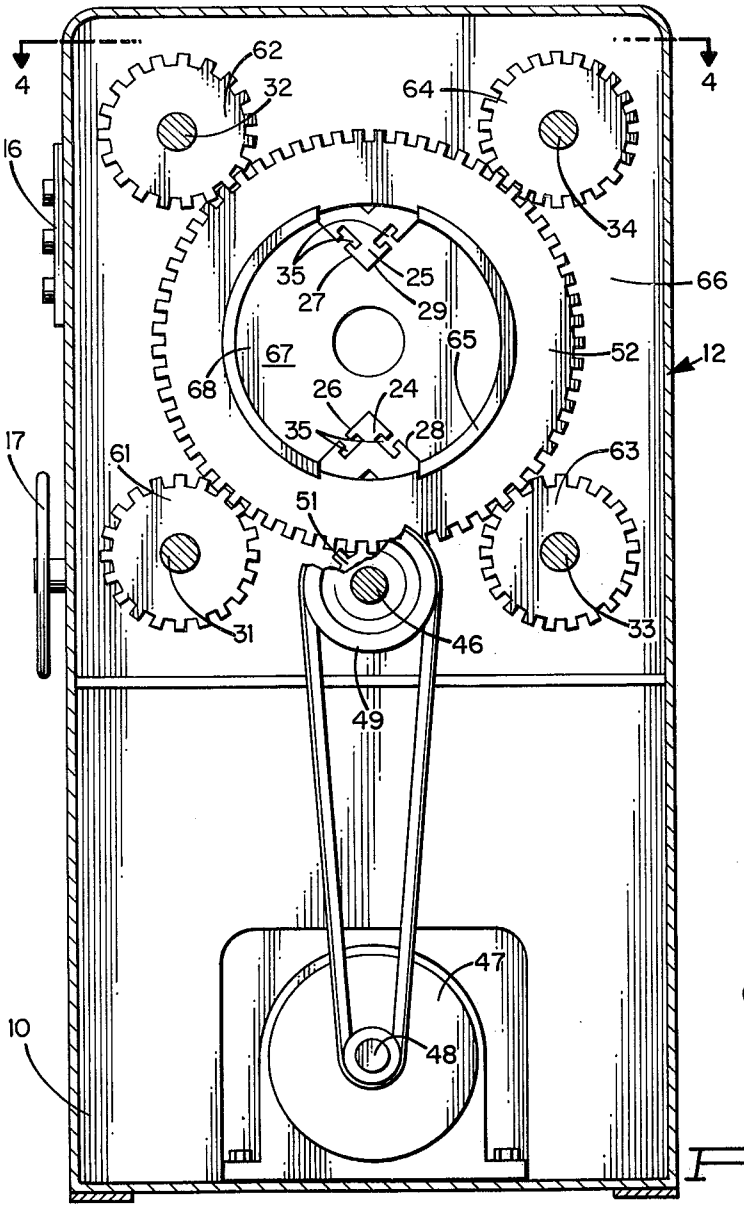
FIG. 3 is a right side elevation with end covers and feed mechanism removed.

As depicted in FIGS. 2 and 3, bed supports 24, 25 and camshafts 31, 32, 33 and 34 exhibit bilateral symmetry in cross section. That is, beds 26, 28, their respective tee-slots 35 and camshafts 31, 33 are symmetrical, about a straight line drawn midway between bed supports 24 and 25, with beds 27, 29, their respective tee-slots 35 and camshafts 32, 34. Similarly, beds 26, 27, their respective tee-slots 35 and camshafts 31, 32 are symmetrical, about a straight line bisecting beds 24 and 25, with beds 28, 29, their respective tee-slots 35 and camshafts 33, 34. The straight lines in both instances are in the plane of the cross section. It will thus be seen that the line formed by the intersecting planes of bed surfaces 26, 28 of bed support 24 is opposite the line formed by the intersecting planes of bed surfaces 27, 29 of bed support 25, and bed supports 24 and 25 face each other along the two lines so formed in bilateral symmetry. This bilateral symmetry exists in both transverse and longitudinal section.

Also depicted in FIGS. 2 and 3 is main drive shaft 46 extending internally of bed support 24 throughout its length. The operation of drive shaft 46 and its interconnections with the main moving components of the inventive apparatus is depicted in FIG. 3. FIG. 3 depicts the apparatus of FIG. 1 looking at it from the right end as depicted in FIG. 1 with extension covers 18 and 20 removed as well as the stock feed mechanism which will be described below in connection with FIG. 4. Main drive motor 47 is mounted in the bottom of base 10 and is suitably an electric motor carrying pulley 48 on one end. Second pulley 49 is secured to drive shaft 46. The diameters of pulleys 48 and 49 are selected relative to the rotational speed of motor 47 to provide a preferred speed of operation for the machine. Pulley 49 is partially cut away in FIG. 3 to show spur gear 51. Spur gear 51 coacts with ring gear 52 which in turn actuates further spur gears 61, 62, 63 and 64 which are secured to camshafts 31, 32, 33 and 34 respectively. Ring gear 52 is completely open in its center and is supported on the interior surface of the ring on a bronze or other suitable bearing surface 65 supported from right end supporting wall 66. Aperture 67 in wall 66 provides entrance passage for stock material and, as depicted in FIG. 3, allows a partial view of bed supports 24 and 25 through end wall 66. It will be noted from FIG. 3 that rotation of drive shaft 46 produces simultaneous rotation of all four camshafts 31 through 34.

Supporting wall 66 together with supporting wall 68 on the left end (see FIG. 1) provides the main support for bed supports 24 and 25 as well as holding bearings carrying camshafts 31 through 34.

Figure 4:
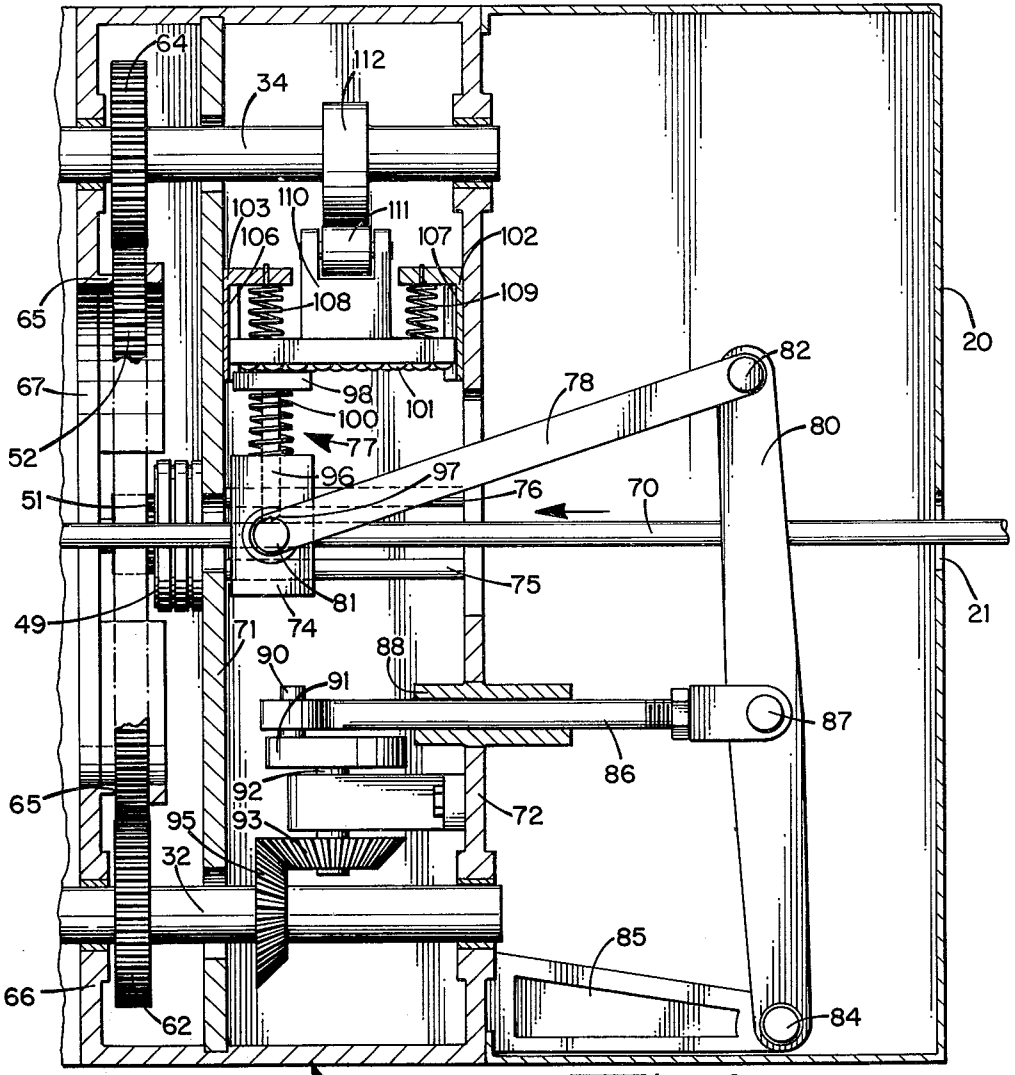
FIG. 4 is a simplified illustration in top plan view with cover removed of a stock feed mechanism for feeding stock material to the machine of FIG. 1.

For operation of the present machine, it is necessary to automatically feed raw stock through the center of aperture 67 between bed supports 24 and 25. Any of various types of stock feed apparatus may be utilized and one example has been depicted in FIG. 4 for purposes of a full disclosure. The example depicted in FIG. 4 was selected primarily for ease of description and has particular relation to the present machine only in the means of synchronizing the stock feed with the operation of the tool slides of the machine. The stock feed mechanism depicted in FIG. 4 is mounted under extension cover 20 (FIG. 1) just to the right (outboard) of ring gear 52. FIG. 4 is largely diagramatic and the various parts depicted are not all in the same plane. FIG. 4 is a top plan view with camshafts 32 and 34 near the top and stock 70 substantially lower. Looking at FIG. 3, stock 70 would be in line with the center of aperture 67. Various of the components depicted in FIG. 4 are set at angles to achieve these relative positions. Support panels 71 and 72 provide support for the various parts of the feed mechanism. Panels 71 and 72 are mounted from supporting wall 66 by structural members (not shown).

Synchronization of the feed mechanism with the tool slides is obtained by driving the feed mechanism from the same camshafts operating the tool slides.

Stock advancing slide 74 rides on two cylindrical rods 75 and 76. Stock 70 passes between rods 75 and 76 through an aperture in slide 74. Slide 74 includes gripping mechanism 77 which is actuated intermittently during reciprocation of slide 74 to effect advance of stock 70. Connecting arm 78 connects slide 74 to pivot arm 80. Connecting arm 78 is connected to slide 74 by pivot pin 81 and to pivot arm 80 by further pivot pin 82. Pivot arm 80, which connects at one end by pivot pin 82 to arm 78, is connected at the other end by a further pivot pin 84 to structural member 85 supported from support panel 72. Along arm 80, between pivot pins 82 and 84, connecting rod 86 is connected to arm 80 by still further pivot pin 87. Connecting rod 86 extends through an aperture in panel 72 with its left end proximate to panel 71. Mounted from panel 72 is guideway 88 which serves to stabilize movement of the left end of rod 86 in conventional manner. Connecting rod 86 is additionally connected to crank pin 90 extending from a rotatable member 91 which in turn is connected by axle 92 to a first bevel gear 93. Bevel gear 93 meshes at right angles with second bevel gear 95 secured to camshaft 32.

Referring now back to gripping mechanism 77 - gripping mechanism 77 includes pin 96 on the end of which is gripping prod 97 indicated by dashed lines since it is within slide 74. Pin 96 extends perpendicular to the direction of motion of slide 74 and has, connected across its end, elongated member 98 extending from left to right giving a T-shape. Helical compression spring 100 is positioned over pin 96 between member 98 and the body of slide 74 so as to normally hold prod 97 clear of stock 70. Supported adjacent to member 98 is ball bearing race 101 extending from left to right in a straight line. Supported from panels 71 and 72 are structural members 102 and 103 holding ball bearing race 101. Members 103 and 102 include two guide channels 106 and 107 in which ball bearing race 101 can move toward and away from slide 74. Additionally, helical springs 108 and 109 are positioned between ball bearing race 101 and extension members 103 and 102. Springs 108 and 109 are arranged to urge ball bearing race 101 in the direction away from slide 74. The length of elongated member 98 is selected so that it will always ride on at least two of the ball bearings in race 101.

Extending from the opposite side of race 101 is arm 110 carrying roller bearing 111. Roller bearing 111 rides against cam 112 mounted on camshaft 34. Springs 108 and 109 pull ball bearing race 101 in the direction that forces roller bearing 111 in contact with cam 112. Aperture 115 in end portion allows feed from both ends.

The operation of the machine is as follows: Motor 47 rotates drive shaft 46 which, through ring gear 52, rotates all of camshafts 31, 32, 33 and 34. Cam 112, on camshaft 34, pushes ball bearing race 101 towards slide 74 forcing prod 97 into gripping contact with stock 70. Rotation of camshaft 32 rotates crank 90 to the left whereby connecting rod 86 pulls pivot arm 87 to the left which, in turn, through connecting arm 78, moves slide 74 and thus stock 70 to the left and in between bed supports 24 and 25. It will be recognized that prod 97 moves with slide 74 while member 98 rides across ball bearing race 101. At a point during this motion determined by the shape of cam 112, ball bearing race 101 retracts and spring 100 removes prod 97 from stock 70 halting the advance of stock 70. At this time cams, rotated by shafts 31, 32, 33 and 34, drive tool slides situated on bed surfaces 26, 27, 28 and 29 to provide the desired forming operation on the advanced portion of stock 70. As rotation of the camshafts continues, the tools are retracted and slide 74 is pulled back to the right, due to the operation of rotating crank pin 90, so that the cycle may be repeated.

While the invention has been described with relation to a specific embodiment, many variations are possible without departing from the scope of the invention. Thus, it will be noted that bed supports 24 and 25 each have two surfaces which meet at a 90° angle. This angle in bed support 24 is directly below and facing the equivalent angle of bed support 25. While this is believed to be the most desirable configuration from the point of view of the operating mechanism, the whole arrangement can be rotated about its longitudinal axis so that these angles will be facing each other, from left to right instead of up and down or in any other possible position through a complete 360° rotation. It will be seen that in such a rotation the two bed supports and the four camshafts must be rotated as a unit without changing their relative position. Thus it is intended to cover the invention within the full scope of the appended claims.

I claim:

1. A metal forming machine for forming metal components from wire or metal strip by passing a length of wire or metal strip between reciprocally operated forming slides comprising:

a. a machine frame;

b. a first bed support extended along a first axis mounted within said frame, said first bed support carrying two bed surfaces having planes lying perpendicular to each other;

c. a second bed support extended along a second axis parallel to said first axis mounted within said frame, said second bed support carrying two bed surfaces having planes lying perpendicular to each other and the bed surface planes of said second bed support being parallel to respective bed surface planes of said first bed support;

d. means integral with said first and second bed supports to support a plurality of tool carriers from each of said bed surfaces; and, e. means to provide reciprocating motion to tools in tool carriers supported from said bed surfaces.

2. A metal forming machine according to claim 1 wherein said second bed support lies vertically above said first bed support, the line formed by the intersecting planes of the bed surfaces of the first bed support opposite the line formed by the intersecting planes of the bed surfaces of the second bed support, and the two bed supports facing each other along the two lines so formed with both longitudinal and transverse bilateral symmetry.

3. A metal forming machine according to claim 1 wherein said means to support a plurality of tool carriers is a slot extending longitudinally along each bed surface for retaining tool carrier anchor bolts.

4. A metal forming machine according to claim 1 wherein each of said first bed support and said second bed support carries two additional bed surfaces on its reverse side.

5. A metal forming machine according to claim 1 wherein said means to provide reciprocating motion to said tools is a plurality of cams mounted on four camshafts positioned symmetrically around said bed supports and extending parallel to said first axis.

6. A metal forming machine according to claim 5 further comprising a ring gear in driving relationship with said four camshafts, said ring gear centered symmetrically between said first axis and said second axis.

7. A metal forming machine according to claim 6 wherein said ring gear has a central aperture for passage of stock material.

8. A metal forming machine according to claim 7 further comprising a drive shaft in driving relationship with said ring gear, said drive shaft extending internally through the length of said first bed support and a motor connected to drive said drive shaft.

9. A metal forming machine according to claim 5 further comprising means to pass a length of stock material along a central axis midway between said first axis and said second axis so as to pass through the operative positions of tools in said tool carriers mounted on said bed surfaces.

10. A metal forming machine according to claim 9 wherein said means to pass a length of stock material is an intermittent advancing mechanism connected to be driven by at least one of said four camshafts.

11. A metal forming machine according to claim 10 further comprising a slide member, a gripping member coacting with said slide member, a first mechanical linkage between one of said camshafts and said slide member so as to provide reciprocating motion to said slide member and a second mechanical linkage between one of said camshafts and said gripping member so as to intermittently drive said gripping member into gripping engagement with stock material whereby said stock material is locked to a portion of the reciprocal motion of said slide member.

12. A metal forming machine according to claim 11 wherein said first mechanical linkage includes a gear on said one of said camshafts and said second mechanical linkage includes a cam on a second one of said camshafts.

* * * * *